US006547372B1

(12) United States Patent
Michihiro

(10) Patent No.: US 6,547,372 B1
(45) Date of Patent: Apr. 15, 2003

(54) INK JET HEAD

(75) Inventor: Toshiaki Michihiro, Aira-gun (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/199,610

(22) Filed: Jul. 19, 2002

(30) Foreign Application Priority Data

| | | |
|---|---|---|
| Jul. 27, 2001 | (JP) | 2001-228772 |
| Aug. 27, 2001 | (JP) | 2001-255792 |
| Aug. 30, 2001 | (JP) | 2001-261525 |
| Aug. 31, 2001 | (JP) | 2001-263116 |
| May 21, 2002 | (JP) | 2002-146271 |

(51) Int. Cl.[7] ..... B41J 2/05; H01B 1/02

(52) U.S. Cl. ..... 347/62; 252/519.1; 252/519.12; 252/520.2; 252/520.21; 252/521.2; 252/521.3

(58) Field of Search ..... 347/66; 219/216; 252/518.1, 519.1, 519.12, 520.2, 520.21, 521.2, 521.3

(56) References Cited

U.S. PATENT DOCUMENTS

| | | | | |
|---|---|---|---|---|
| 4,168,343 A | * | 9/1979 | Arai et al. | 428/426 |
| 5,790,154 A | * | 8/1998 | Mitani et al. | 347/59 |
| 6,299,294 B1 | * | 10/2001 | Regan | 347/62 |

FOREIGN PATENT DOCUMENTS

| | | |
|---|---|---|
| JP | 48-53292 | 7/1973 |
| JP | 52-109947 | 9/1977 |
| JP | 53-011037 | 2/1978 |
| JP | 56-154072 | 11/1981 |
| JP | 57-061581 | 4/1982 |
| JP | 57-061582 | 4/1982 |
| JP | 62-56388 | 3/1987 |
| JP | 7-12689 | 2/1995 |
| JP | 07-309025 | 11/1995 |

* cited by examiner

*Primary Examiner*—John Barlow
*Assistant Examiner*—Michael S Brooke
(74) *Attorney, Agent, or Firm*—Hogan & Hartson, LLP

(57) ABSTRACT

The present invention provides an ink jet head comprising a head substrate 1, a heat-generating resistor 3 and a pair of electrodes 4, which are attached on the head substrate 1, and a top plate 6 disposed above the head substrate 1, the ink jet head being capable of ejecting ink, with which the space between the head substrate 1 and the top plate 6 is filled, through an ink ejection opening by means of heat of the heat-generating resistor, wherein the heat-generating resistor is made of a silicon oxide material selected from the group consisting of (1) a material consisting of $Ta_xSiO_y$ ($1.30 \leqq x \leqq 1.70$ and $1.20 \leqq y \leqq 1.95$), (2) a material consisting of $Nb_xSiO_y$ ($1.4 \leqq x \leqq 1.9$ and $1.4 \leqq y \leqq 1.9$), (3) a TiC—$SiO_2$ resistive material, a TiC content in the resistive material being set within a range from 55 to 90 mol %, and (4) a Ta—Ni—$SiO_x$ ($1.2 \leqq x \leqq 2.0$) resistive material, a Ta content in the resistive material being set within a range from 48 to 70 atomic %, a Ni content being set within a range from 0.1 to 2.0 atomic %. This ink jet head can record an image with less strain and uneven density at a high speed, and also has a high reliability.

5 Claims, 2 Drawing Sheets

INK JET HEAD

BACKGROUND OF THE INVENTION

The present invention relates to an ink jet head, which forms an image by applying ink drops on a recording paper in a predetermined pattern.

As a recording device for forming an image on a recording paper, an ink jet head has hitherto been used. A recording system of the ink jet head includes, for example, a recording system which utilizes thermal energy generated by a heat-generating resistor or deformation of a piezoelectric element in case of ejecting ink drops toward a recording paper, and a recording system which utilizes heat generated with irradiation of electromagnetic wave. Among these recording systems, the recording system, which utilizes thermal energy of the heat-generating resistor, has been attracted special interest recently as a recording system suited to cope with high-density recording because the heat-generating resistor is easily patterned and comparatively large energy can be generated even in case of a heat-generating resistor having a small area.

Such a conventional ink jet head has a structure that a head substrate comprising a base plate, a lot of heat-generating resistors and a pair of electrodes connected to both sides of each of the heat-generating resistors, and a top plate having a lot of ink ejection openings corresponding to each of the heat-generating resistors are disposed on the base plate so as to form a predetermined space between them, and also the space between the head substrate and the top plate is filled with ink. While carrying a recording paper along the outer surface of the top plate, each of the heat-generating resistors is allowed to selectively generate heat based on image data from the outside and air bubbles are generated in ink by means of this heat energy and, at the same time, a portion of ink is ejected outside through each of the ink ejection openings of the top plate. Then, ink is applied at a predetermined position of the recording paper, thereby recording a predetermined image.

A lot of the heat-generating resistors are generally made of an electric resistive material such as $Ta_2N$, TaAl, TaSi or $HfB_2$ and a power pulse to be applied to these heat-generating resistors has a pulse width of 10 to 12 $\mu$sec and a power value of 0.33 to 0.40 W.

By the way, it is recently required to eject ink drops outside by quickly generating air bubbles in ink in order to respond to the demand of high-speed recording with a driving cycle of 0.1 msec or less. To meet the demand, it is necessary to allow the heat resistor to generate heat of high temperature (500 to 800° C.) in a short time by applying a power pulse having a larger amplitude and a shorter pulse width than that of the prior art (pulse width: 0.5 to 2.0 $\mu$sec, power value: 1.60 to 4.10 W) to the heat-generating resistor.

However, in aforementioned conventional ink jet head, since the heat-generating resistor is made of $Ta_2N$ or TaAl, the resistance value is drastically reduced because crystallization of the heat-generating resistor arises, when using the ink jet head while repeatedly applying a large power pulse to the heat-generating resistor, thus making it impossible to allow the heat-generating resistor to generate heat at a desired temperature. As a result, scatter in ejection rate of ink drops arises and it becomes impossible to allow ink drops to arrive at a desired position, thereby to cause drawbacks, for example, poor printing such as strain of the image formed on a recording paper.

Because of insufficient mechanical strength, $Ta_2N$ and TaAl, which constitute the heat-generating resistor, also had such drawbacks that breakage such as cracking of the heat-generating resistor is caused by the shock of air bubbles collapsing occurred in ink when the heat-generating resistor is allowed to generate heat repeatedly for a long time.

By the way, apart from the ink jet head, a thermal head is known. For example, Japanese Published Unexamined Patent Application (Kokai Tokkyo Koho) No. 154072/1981 discloses that thin-film heat-generating resistors of a thermal head are made of a material consisting essentially of $Ta_xSi_yO_z$. Also Japanese Published Unexamined Patent Application (Kokai Tokkyo Koho) No. 56388/1987 discloses that TiC—$SiO_2$ is used in thin-film heat-generating resistors of a thermal head. However, as described in these Kokai Publications, the thermal head is characterized in that color development of a predetermined portion of a heat-sensitive recording paper is conducted with heating by selectively applying an electric pulse to thin-film heat-generating resistors, said recording paper being contacted to the thermal head. That is, the thermal head is different from the ink jet head each other in a function and a use of their heat-generating resistor, and the ink jet head is required to have a heat-generating head which can be used even under repeatedly applying a power pulse having a larger amplitude and a shorter pulse width than that of a thermal head.

The present invention has been made to overcome drawbacks of a conventional ink jet head and an object thereof is to provide an ink jet head which is capable of recording a good image with less strain and is suited for high-speed recording, and also has a high reliability.

SUMMARY OF THE INVENTION

The ink jet head of the present invention comprises a head substrate, a heat-generating resistor and a pair of electrodes, which are attached on the head substrate, and a top plate disposed above the head substrate, the ink jet head being capable of ejecting ink, with which the space between the head substrate and the top plate is filled, through an ink ejection opening by means of heat of the heat-generating resistor, wherein the heat-generating resistor is made of a silicon oxide material selected from the group consisting of (1) a material consisting of $Ta_x SiO_y$ (provided that x and y meet the expressions: $1.30 \leqq x \leqq 1.70$ and $1.20 \leqq y \leqq 1.95$), (2) a material consisting of $Nb_xSiO_y$ (provided that x and y meet the expressions: $1.4 \leqq x \leqq 1.9$ and $1.4 \leqq y \leqq 1.9$), (3) a TiC—$SiO_2$ resistive material, a TiC content in the resistive material being set within a range from 55 to 90 mol %, and (4) a Ta—Ni—$SiO_x$ (provided that x meets the expression: $1.2 \leqq x \leqq 2.0$) resistive material, a tantalum (Ta) content in the resistive material being set within a range from 48 to 70 atomic %, a nickel (Ni) content being set within a range from 0.1 to 2.0 atomic %.

The ink jet head of the present invention includes the following embodiments.

The ink jet head is characterized in that the heat-generating resistor is coated with a protective layer made of an inorganic compound containing at least 0.5 atomic % of oxygens (O).

The ink jet head is characterized in that the protective layer is made of a Si—O—N inorganic compound.

The ink jet head is characterized in that the oxygen content in the protective layer is gradually increased toward the side of the heat-generating resistor.

The ink jet head is characterized in that a pair of the electrodes are made of aluminum (Al) and contain 0.01 to 0.1 atomic % of silicons (Si) in the vicinity of an interface with the heat-generating resistor.

According to the ink jet head of the present invention, since the heat-generating resistor is made of any material selected from the silicon oxide materials (1) to (4), it is made possible to effectively prevent crystallization of the heat-generating resistor. Therefore, even if a large power pulse is repeatedly applied to the heat-generating resistor in a short time so as to conduct high-speed recording with a driving cycle of 0.1 msec or less, the resistance value of the heat-generating resistor is maintained at a nearly constant value for a long period and, therefore, the heat-generating resistor is always allowed to generate heat at a desired temperature and the ejection rate of ink drops is made uniform, and thus it is made possible to obtain a good image with less strain.

In this case, since the mechanical strength of the heat-generating resistor made of any of aforementioned materials (1) to (4) is increased by markedly reducing a stress accumulated therein, breakage such as cracking of the heat-generating resistor is hardly caused by the shock of air bubbles collapsing occurred in ink even if the heat-generating resistor is allowed to generate heat repeatedly for a long time, and thus the reliability of the ink jet head is improved.

According to the ink jet head of the present invention, since the heat-generating resistor is coated with a protective layer made of an inorganic compound containing at least 0.5 atomic % of oxygens, it is made possible to increase the adhesive strength of the protective layer to the heat-generating resistor by firmly bonding oxygens in the protective layer with silicons in the heat-generating resistor, and to effectively prevent the protective layer from peeling off from the heat-generating resistor due to the shock of air bubbles collapsing occurred in ink.

Furthermore, according to the ink jet head of the present invention, since a lot of oxygens in the protective layer are distributed in the vicinity of the heat resistor by gradually increasing the oxygen content in the protective layer toward the side of the heat-generating resistor, the number of bonds between silicons and oxygens is increased, and thus the adhesive strength of the protective layer is further enhanced.

Furthermore, according to the ink jet head of the present invention, since a pair of aforementioned electrodes are made of aluminum and merely 0.01 to 0.1 atomic % of silicons, which existed in the heat-generating resistor, is diffused in the lower region of these electrodes, silicons are satisfactorily bonded with aluminums in the vicinity of an interface between the heat-generating resistor and a pair of electrodes, and thus a pair of electrodes can be firmly attached to the heat-generating resistor. Therefore, even if the shock of air bubbles collapsing occurred in ink is repeatedly applied to the heat-generating resistor, breakage such as peeling of a pair of electrodes from the heat-generating resistor is effectively prevented.

BRIEF DESCRIPTION OF THE REFERENCE SYMBOLS

Figure 1:
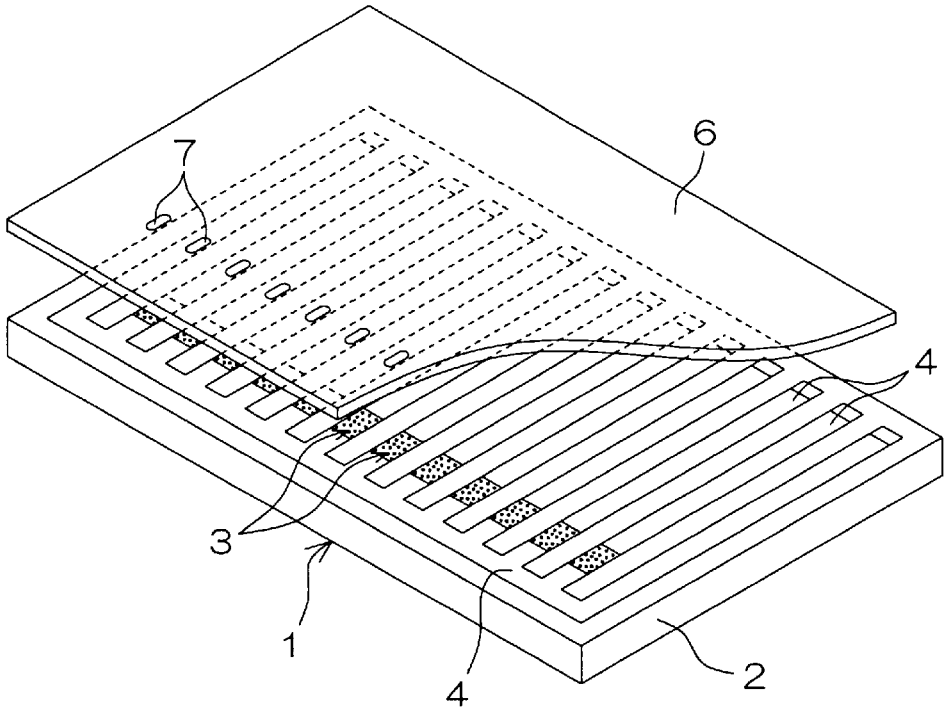
FIG. 1 is an exploded perspective view of an ink jet head according to one embodiment of the present invention.

1: head substrate
2: base plate
3: heat-generating resistor
4: pair of electrodes
5: protective layer
6,6': top plates
7,7': ink ejection openings
8: ink
9: nozzle member

DESCRIPTION OF THE PREFERRED EMBODIMENTS

The embodiments of the ink jet head of the present invention will be described in detail with reference to the accompanying drawings.

Figure 2:
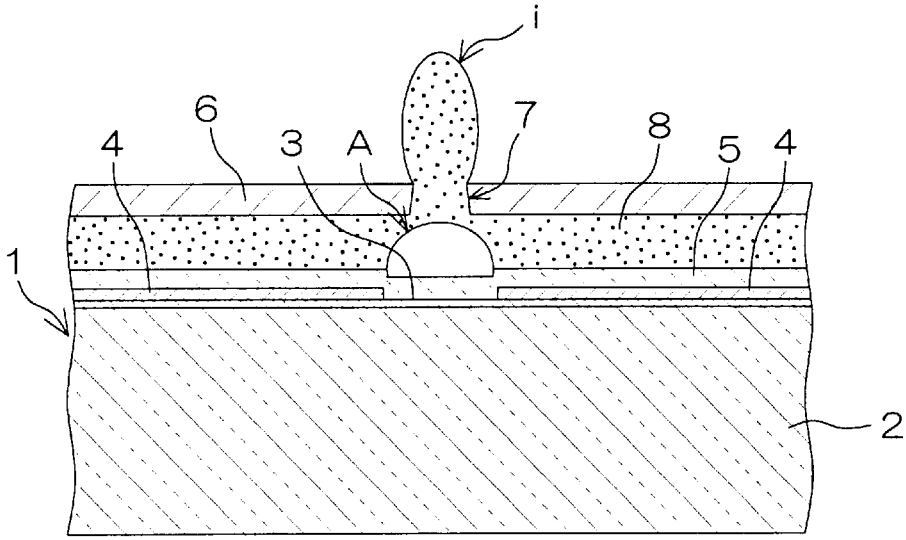
FIG. 2 is a cross-sectional view showing the principal part of the ink jet head of FIG. 1.
Figure 3:
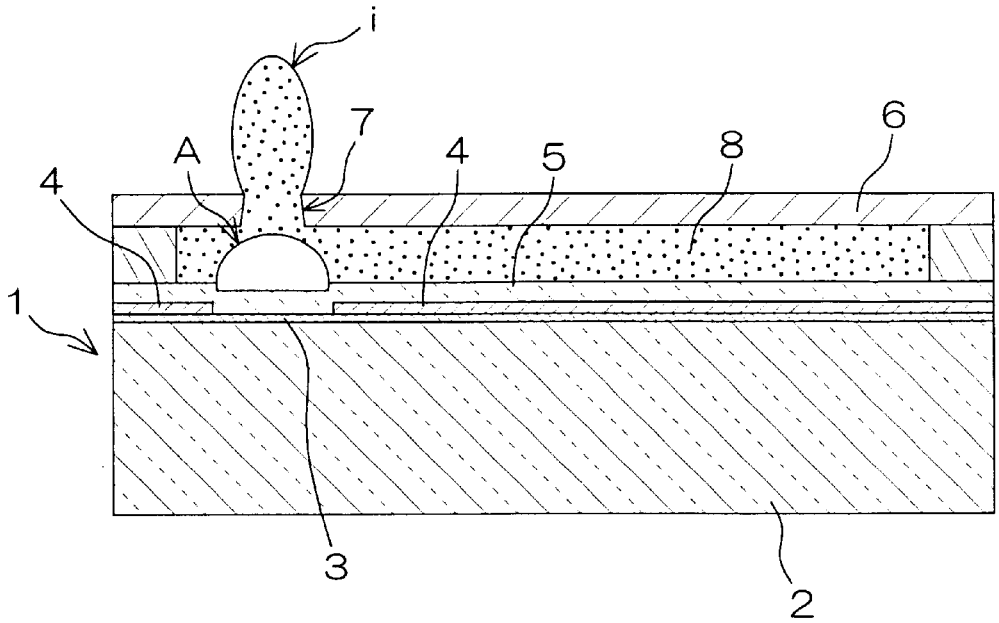
FIG. 3 is a cross-sectional view of an ink jet head of FIG. 1.
Figure 4:
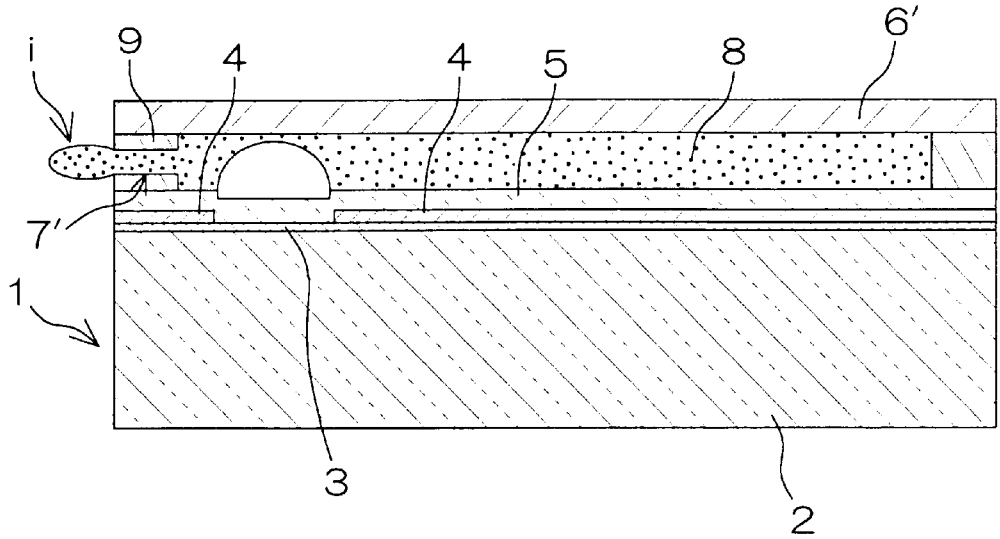
FIG. 4 is a cross-sectional view of an ink jet head according to another embodiment of the present invention.

FIG. 1 is an exploded perspective view of an ink jet head according to one embodiment of the present invention and FIG. 2 is a cross-sectional view showing the principal part of the ink jet head of FIG. 1, and the ink jet head shown in the same drawing is generally composed of a head substrate 1, a top plate 6, and ink 8 with which the space between the both is filled. FIG. 3 is a cross-sectional view of an ink jet head of FIG. 1, and shows an example wherein an ink ejection opening 7 is projectingly formed on the top plate 6. FIG. 4 is a cross-sectional view of an ink jet head according to another embodiment of the present invention, and shows an example wherein an ink ejection opening 7' is not formed on the top plate 6 and is projectingly formed on a nozzle member 9 disposed in a direction perpendicular to a top plate 6' at one end of the head substrate 1.

The head substrate 1 has such a structure that a heat-generating resistor 3, a pair of electrodes 4 and a protective layer 5 are attached in order on a base plate 2. The base plate 2 is made of alumina ceramics, a single silicon crystal or a Fe—Ni alloy and functions as a supporting base material for supporting the heat-generating resistor 3, a pair of the electrodes 4 and the protective layer 5 thereon.

When the base plate 2 is made of alumina ceramics, it is produced by mixing raw ceramic powders made of alumina, silica or magnesia with a proper organic solvent or solvent media to form a slurry, forming the slurry into a green ceramic sheet using a conventionally known doctor blade or calendering roll method, punching to a green ceramic sheet having a predetermined shape, and sintering at high temperature.

A lot of heat-generating resistors 3 formed on a top surface of the base plate 2 are linearly disposed in a density of 600 dpi (dot per inch) in a main scanning direction and each of them is made of the heat-generating resistor 3 of any of the following silicon oxide materials (1) to (4):

(1) a material consisting of $Ta_xSiO_y$ (provided that x and y meet the expressions: $1.30 \leqq x \leqq 1.70$ and $1.20 \leqq y \leqq 1.95$), (2) a material consisting of $Nb_xSiO_y$ (provided that x and y meet the expressions: $1.4 \leqq x \leqq 1.9$ and $1.4 \leqq y \leqq 1.9$), (3) a TiC—$SiO_2$ resistive material, a TiC content in the resistive material being set within a range from 55 to 90 mol %, and (4) a Ta—Ni—$SiO_x$ (provided that x meets the expression: $1.2 \leqq x \leqq 2.0$) resistive material, a tantalum (Ta) content in the resistive material being set within a range from 48 to 70 atomic %, a nickel (Ni) content being set within a range from 0.1 to 2.0 atomic %, and balance is a trace amount (0.5% by weight or less) of impurity (Fe, C).

When a predetermined power pulse (pulse width: 0.5 to 2.0 μsec, power value: 1.60 to 4.10 W) is applied from the outside through a pair of the electrodes 4 connected to both ends of each of the above heat-generating resistors 3, the heat-generating resistor is heated to a predetermined temperature (500 to 800° C.), which is required to generate air bubbles A in ink 8, by Joule heat generation.

Since the heat-generating resistor 3 is made of aforementioned materials (1) to (4), it is made possible to effectively prevent crystallization of the heat-generating resistor 3 during driving the ink jet head. Therefore, even if a large power pulse is repeatedly applied to the heat-generating resistor 3 in a short time so as to conduct high-speed recording with a driving cycle of 0.1 msec or less, the resistance value of the heat-generating resistor 3 is maintained at a nearly constant value for a long period and, therefore, the heat-generating resistor 3 is always allowed to generate heat at a desired temperature and the ejection rate of ink drops is made uniform, and thus it is made possible to obtain a good image with less strain.

Moreover, since the mechanical strength of the heat-generating resistor 3 made of aforementioned materials (1) to (4) is increased by markedly reducing a stress accumulated therein, breakage such as cracking of the heat-generating resistor 3 is hardly caused by the shock of air bubbles collapsing occurred in ink 8 even if the heat-generating resistor 3 is allowed to generate heat repeatedly for a long time, and thus the reliability of the ink jet head is improved.

In the heat-generating resistor 3 made of the material (1), the composition of $Ta_xSiO_y$ is adjusted so that x and y meet the expressions: $1.30 \leqq x \leqq 1.70$ and $1.20 \leqq y \leqq 1.95$ by the following reason. When x is allowed to meet the expression: $x<1.30$, there arise drawbacks that the heat-generating resistor 3 is insufficient in mechanical strength and the heat-generating resistor 3 is broken by the shock of air bubbles collapsing occurred in ink 8. When x and y are set so as not to meet the expressions: $1.30 \leqq x \leqq 1.70$ and $1.20 \leqq y \leqq 1.95$, there arise drawbacks that, when using the ink jet head while applying a large power pulse for a long period, crystallization of the heat-generating resistor 3 occurs, thereby to drastically reduce the resistance value and to cause scatter in ejection rate of ink drops i. Therefore, it is important that the heat-generating resistor is made of a material consisting of $Ta_xSiO_y$ (provided that x and y meet the expressions: $1.30 \leqq x \leqq 1.70$ and $1.20 \leqq y \leqq 1.95$).

In the heat-generating resistor 3 made of the material (2), the composition of $Nb_xSiO_y$ is set within a range of $1.4 \leqq x \leqq 1.9$ and $1.4 \leqq y \leqq 1.9$ by the following reason. That is, when x is allowed to meet the expression: $x<1.4$, the heat-generating resistor 3 is often broken by the shock of air bubbles collapsing occurred in ink 8 because of insufficient mechanical strength. When x and y are set so as not to be within $1.4 \leqq x \leqq 1.9$ and $1.4 \leqq y \leqq 1.9$, there arise drawbacks that, even if the heat-generating resistor 3 is not broken, when using the ink jet head while applying a large power pulse for a long period, crystallization of the heat-generating resistor 3 occurs, thereby to drastically reduce the resistance value and to cause scatter in ejection rate of ink drops i. Therefore, it is important that the heat-generating resistor is made of a material consisting of $Nb_xSiO_y$ (x and y meet the expressions: $1.4 \leqq x \leqq 1.9$ and $1.4 \leqq y \leqq 1.9$).

In the heat-generating resistor 3 made of the material (3), the TiC content is set within a range from 55 to 90 mol % by the following reason. When the TiC content exceeds 90 mol %, the film thickness of the heat-generating resistor 3 must be set to a very small value so as to obtain a desired resistance value because the specific resistance of the heat-generating resistor 3 becomes very small. When a current is allowed to flow through such a heat-generating resistor 3, the current density is likely to become too large, thereby to promote crystallization of the heat-generating resistor 3 and to shorten the life time. On the other hand, when the TiC content is smaller than 55 mol %, insufficient mechanical strength of the heat-generating resistor 3 increases the risk that the heat-generating resistor 3 is broken in case large shock air bubbles A collapsing is repeatedly applied to the heat-generating resistor 3. Therefore, it is important that the TiC content in the heat-generating resistor 3 is set within a range from 55 to 90 mol %.

In the heat-generating resistor 3 made of the material (4), when the tantalum (Ta) content in the heat-generating resistor 3 exceeds 70 atomic %, crystallization of the heat-generating resistor 3 is promoted by current, which flows through the heat-generating resistor 3, and the life time of the heat-generating resistor 3 is likely to be shortened. On the other hand, when the tantalum (Ta) content is smaller than 48 atomic %, there is a disadvantage that the heat-generating resistor is insufficient in mechanical strength.

In the heat-generating resistor 3 made of the material (4), when the nickel (Ni) content in the heat-generating resistor 3 exceeds 2.0 atomic %, segregation of nickel (Ni) occurs upon heat generation of the heat-generating resistor 3 in case of using the ink jet head for a long period while applying a large power pulse, crystallization of the heat-generating resistor 3 is promoted by current, and the resistance value of the heat-generating resistor 3 is likely to be drastically reduced. On the other hand, when the nickel (Ni) content is smaller than 0.1 atomic %, it becomes impossible to satisfactorily bond each composition in the heat-generating resistor 3 with nickel (Ni) and there is a disadvantage that the mechanical strength of the heat-generating resistor itself is not sufficiently improved.

In the heat-generating resistor 3 made of the material (4), a Ta—Ni—$SiO_x$ ($1.2 \leqq x \leqq 2.0$) resistive material is set by the following reason. When the ratio x is allowed to meet the expression: $x<1.2$, the resistance value of the heat-generating resistor 3 becomes too small and there is a disadvantage that the power consumption of the ink jet head becomes too large. On the other hand, when the ratio x is allowed to meet the expression: $x<2.0$, the resistance value of the heat-generating resistor 3 becomes too large and a long time is required to allow the heat-generating resistor 3 to generate heat at a desired temperature, thereby making it difficult to realize an ink jet head which can be used for high-speed recording with a driving cycle of 0.1 msec or less.

Therefore, it is important that heat-generating resistor 3 is made of a Ta—Ni—$SiO_x$ ($1.2 \leqq x \leqq 2.0$) resistive material and, furthermore, a tantalum (Ta) content is set within a range from 48 to 70 atomic % and a nickel (Ni) content is set within a range from 0.1 to 2.0 atomic %.

With respect to the heat-generating resistor 3 made of aforementioned electric resistive material, crystallization of the heat-generating resistor 3 is effectively prevented by an action of nickel (Ni), the resistance value of the heat-generating resistor 3 can be maintained at a nearly constant value for a long period, the mechanical strength of the heat-generating resistor 3 is increased by an action of nickel (Ni), and thus the reliability of the ink jet head can be improved.

The heat-generating resistor 3 made of aforementioned electric resistive materials (1) to (4) is formed by depositing aforementioned resistive material in a predetermined thickness on a base plate 2 employing a conventionally known sputtering technique to form a resistor film, and forming the film into a predetermined pattern employing a conventionally known photolithographic or etching technique.

Further, $Ta_{1.50}SiO_{1.50}$ is for example used as a target material in case of sputtering the heat-generating resistor 3 made of the aforementioned material (1), which is prepared by mixing powders of tantalum (Ta), tantalum silicide ($TaSi_2$) and silicon dioxide ($SiO_2$) in a molar ratio of 1:1:1 and sintering the mixture.

Further, $Nb_{1.5}SiO_{1.5}$ is for example used as a target material in case of sputtering the heat-generating resistor 3 made of the aforementioned material (2), which is prepared by mixing powders of niobium (Nb), niobiumsilicide ($NbSi_2$) and silicon dioxide ($SiO_2$) in a molar ratio of 1:1:1 and sintering the mixture.

In addition, $(TiC)_{60}(SiO_2)_{40}$ is for example used as a target material in case of sputtering the heat-generating resistor 3 made of the aforementioned material (3), which is prepared by mixing powders of TiC and silicon dioxide ($SiO_2$) in a molar ratio of 60:40 and sintering the mixture.

Furthermore, $Ta_{50}(SiO_{1.5})_{48}Ni_2$ is for example used as a target material in case of sputtering the heat-generating resistor 3 made of the aforementioned material (4), which is prepared by mixing powders of tantalum (Ta), silicon dioxide ($SiO_2$), tantalum silicide ($TaSi_2$) and nickel (Ni) in a molar ratio of 38:36:12:2 and sintering the mixture.

In the ink jet head of the present invention, a pair of electrodes 4 connected to the heat-generating resistor 3 are attached and formed so as to form a predetermined pattern using a metal such as aluminum (Al) or copper (Cu), and have an action of supplying an electric power supplied from an external electric circuit to the heat-generating resistor 3.

When a pair of these electrodes 4 are made of aluminum and 0.01 to 0.1 atomic % of silicons are incorporated in the vicinity of the interface with the heat-generating resistor 3 (region which is 20 to 100 Å away from an interface to the side of electrodes 4), namely, only 0.01 to 0.1 atomic % of silicons, which existed in the heat-generating resistor 3, is diffused at the lower region of a pair of the electrodes 4, silicons are satisfactorily bonded with aluminums in the vicinity of the interface between the heat-generating resistor 3 and a pair of the electrodes, thus making it possible to firmly attach a pair of the electrodes to the heat-generating resistor 3. Therefore, failure such as peeling of a pair of the electrodes 4 from the heat-generating resistor 3 can be effectively prevented even if the shock of air bubbles A collapsing occurred in ink 8 is repeatedly applied to the heat-generating resistor 3.

At this time, when the silicon content in the vicinity of the interface with the heat-generating resistor 3 is smaller than 0.01 atomic %, a pair of the electrodes 4 can not be firmly attached to the heat-generating resistor 3 because of slightly small numbers of silicons to be bonded with aluminums. On the other hand, when the silicon content in the vicinity of the interface with the heat-generating resistor 3 is larger than 0.1 atomic %, since the number of silicons becomes slightly excessive in the vicinity of the interface, the electric resistance of this portion becomes large and the power consumption of this portion increases. Therefore, it is preferred that a pair of the electrodes 4 are made of aluminum and 0.01 to 0.1 atomic % of silicons is incorporated in the vicinity of the interface with the heat-generating resistor 3.

A pair of the electrodes 4 are formed in a thickness of 0.1 to 0.8 $\mu$m by forming a predetermined pattern having a predetermined thickness on a base plate 2 employing a conventionally known thin film technique, for example, sputtering, photolithographic or etching technique. To incorporate 0.01 to 0.1 atomic % of silicons in the vicinity of the interface with the heat-generating resistor 3, the heat-generating resistor 3 and a pair of the electrodes 4 are formed, and then a predetermined amount of silicons in the heat-generating resistor 3 is diffused into the electrodes 4 by heating the heat-generating resistor and the electrodes to a temperature of 380 to 550° C. for 120 to 600 seconds.

On the heat-generating resistor 3, a protective layer 5 is formed so as to cover the heat-generating resistor and the electrodes.

The protective layer 5 is made of a dense inorganic compound such as $Si_3N_4$ or Si—O—N and has an action of protecting the heat-generating resistor 3 from corrosion due to contact with moisture in ink.

When the protective layer 5 is made of an inorganic compound containing at least 0.5 atomic % of oxygens, such as Si—O—N, silicons in the heat-generating resistor 3 is firmly bonded with oxygens in the protective layer 5, thereby making it possible to increase the adhesive strength of the protective layer 5 to the heat-generating resistor 3.

In this case, when the oxygen content of the protective layer 5 is gradually increased toward the side of the heat-generating resistor 3, a lot of oxygens in the protective layer 5 are distributed in the vicinity of the heat-generating resistor. Therefore, it becomes easily to bond silcons in the heat-generating resistor 3 to oxygens in the protective layer 5 more firmly, thereby making it possible to further increase the adhesion strength of the protective layer 5.

When the protective layer 5 is made of Si—O—N, it is attached and formed in a predetermined thickness on the top surface of the heat-generating resistor 3 employing a conventionally known sputtering technique. To gradually increase the oxygen content in the protective layer 5 toward the heat-generating resistor 3, in case of forming a film by sputtering, the protective layer 5 is formed while gradually decreasing the concentration of the oxygen gas to be injected into the chamber of the sputtering apparatus.

On the head substrate 1, the top plate 6 is disposed approximately parallel to the head substrate 1 so that a predetermined gap (e.g. 20 to 300 $\mu$m) is formed between them.

The top plate 6 is provided with a lot of generally circular ink ejection openings 7 corresponding to each of the heat-generating resistors 3, and is fixed on the head substrate 1 through a spacer so that the ink ejection openings 7 are located just above the heat-generating resistors 3.

A diameter of each of a lot of aforementioned ink ejection openings 7 is set within a range from 10 to 100 $\mu$m and, when bubbles A are generated in ink 8 with heat generation of the heat-generating resistor 3 upon recording operation of the ink jet head, ink drops i are ejected through the ink ejection openings 7 toward a recording paper by means of a pressure upon generation of bubbles.

The top plate 6 is made of a metal such as molybdenum, an electric insulating material, or a photosensitive resin. For example, when the top plate is made of molybdenum, the top plate is produced by forming an ingot of molybdenum into a plate having a predetermined thickness employing a conventionally known metalworking technique and projectingly forming ink ejection openings 7 on the resulting plate in the thickness direction employing a conventionally known laser machining technique. The resulting top plate 6 is fixed by disposing on the head substrate 1 through a spacer.

As the ink 8, with which the space between the head substrate 1 and the top plate 6 is filled, for example, pigment type water-based ink or water-based dye ink is used and the ink 8 is supplied to the space between the head substrate 1 and the top plate 6 from an ink tank. When air bubbles A are generated in ink 8 by means of heat energy with heat generation of aforementioned heat-generating resistor 3, a portion of the ink 8 is converted into ink drops i by means of a pressure of the air bubbles and then ejected outside through each of the ink ejection openings 7.

Thus, aforementioned ink jet head allows each of a lot of heat-generating resistors 3 to selectively generate heat based on image data from the outside while carrying a recording paper on ink ejection openings 7 along the outer surface of the top plate 6, and to selectively generate air bubbles A on each of heat-generating resistors 3 by means of this heat energy. At the same time, the ink jet head allows a portion of the ink 8 to eject outside through ink ejection openings 7 of the top plate 6 by means of a pressure due to generated air bubbles A and to apply ejected ink drops i on the recording paper, thereby recording a predetermined image.

Aforementioned embodiments are to be construed in all respects as illustrative and not restrictive and various changes and modification can be made without departing from the scope of the present invention.

While the plate 6 was provided with ink ejection openings 7 and the ink ejection openings 7 were disposed just above the heat-generating resistor 3 in aforementioned embodiments, the ink ejection openings 7 may be disposed while being slid toward the heat-generating resistor 3 and, in case of applying the present invention to an edge shooter type ink jet head wherein ink drops i are ejected through the edge of the head substrate 1, the top plate 6 is not provided with the ink ejection openings and the ink ejection openings 7' may be projectingly formed on the nozzle member 9 disposed in a direction perpendicular to the top plate 6' at one end of the head substrate 1, as shown in FIG. 3.

In aforementioned embodiments, if the base plate 2 is heated to a temperature within a range from 200 to 500° C. when the heat-generating resistor 3 is attached on the base plate 2 by a sputtering technique, the adhesion between the base plate 2 and the heat-generating resistor 3 can be improved. Therefore, the base plate 2 is preferably heated to a temperature within a range from 200 to 500° C. when the heat-generating resistor 3 is attached on the base plate 2 by a sputtering technique.

Furthermore, as a matter of course, a driver IC capable of controlling heat generation of the heat-generating resistor 3 on the base plate 2 is mounted in aforementioned embodiments.

EXAMPLES

The operation and effect of the present invention will be described by way of Test Examples and Reference Test Example.

Test Example 1

Ink Jet Head Comprising a Heat-generating Resistor Made of Aforementioned Material (1)

In an ink jet head wherein a heat-generating resistor 3 is made of a material consisting of $Ta_xSiO_y$ (provided that x and y meet the expressions: $1.30 \leqq x \leqq 1.70$ and $1.20 \leqq y \leqq 1.95$), 43 ink jet head samples (samples Nos. 1 to 43) were made by gradually changing a ratio x of Ta to Si and a ratio y of O to Si in the heat-generating resistor 3 and a change in resistance value Δ R/R of these samples was measured and, furthermore, the presence or absence of breakage of the heat-generating resistor 3 during the measurement was examined and also the presence or absence of strain of an image recorded on a recording paper was examined using the samples after the measurement. As used herein, the term "change in resistance value ΔR/R" refers to a numerical value represented by the formula: $(\Omega_1-\Omega_2)/\Omega_1 \times 100$ (%), where $\Omega_1$, is a resistance value of a heat-generating resistor 3 before image recording, and $\Omega_2$ is a resistance value after applying a predetermined power pulse (pulsewidth: 0.6 μsec, power value: 2.60 W) $1.0 \times 10^8$ times at a frequency of 10 kHz to the heat-generating resistor 3. The heat-generating resistor 3 of all ink jet head samples used in this test is a heat-generating resistor of 25 μm×25 μm in size and 0.06 μm in thickness. The results of aforementioned test are shown in Table 1.

TABLE 1

| Sample No. | x | y | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ◎: excellent ○: good x: fail |
|---|---|---|---|---|---|---|---|---|
| *1 | 1.20 | 1.00 | 337 | — | impossible to measure | breakage occurred | — | x |
| *2 | 1.20 | 1.20 | 350 | — | impossible to measure | breakage occurred | — | x |
| *3 | 1.20 | 1.50 | 374 | — | impossible to measure | breakage occurred | — | x |
| *4 | 1.20 | 1.95 | 370 | — | impossible to measure | breakage occurred | — | x |
| *5 | 1.20 | 2.20 | 354 | — | impossible to measure | breakage occurred | — | x |
| *6 | 1.30 | 1.00 | 354 | 290 | −18% | no breakage | with strain | x |
| *7 | 1.30 | 1.10 | 366 | 311 | −15% | no breakage | with strain | x |
| 8 | 1.30 | 1.20 | 330 | 314 | −5% | no breakage | no strain | ○ |
| 9 | 1.30 | 1.30 | 324 | 311 | −4% | no breakage | no strain | ○ |
| 10 | 1.30 | 1.50 | 345 | 335 | −3% | no breakage | no strain | ○ |
| 11 | 1.30 | 1.80 | 321 | 311 | −3% | no breakage | no strain | ○ |
| 12 | 1.30 | 1.95 | 330 | 317 | −4% | no breakage | no strain | ○ |
| *13 | 1.30 | 2.00 | 370 | 307 | −17% | no breakage | with strain | x |
| *14 | 1.30 | 2.20 | 365 | 266 | −26% | no breakage | with strain | x |
| 15 | 1.40 | 1.20 | 373 | 358 | −4% | no breakage | no strain | ○ |
| 16 | 1.40 | 1.30 | 354 | 347 | −2% | no breakage | no strain | ◎ |
| 17 | 1.40 | 1.50 | 318 | 312 | −2% | no breakage | no strain | ◎ |
| 18 | 1.40 | 1.70 | 361 | 354 | −2% | no breakage | no strain | ◎ |

TABLE 1-continued

| Sample No. | x | y | Resistance value $\Omega_1$ before image recording ($\Omega$) | Resistance value $\Omega_2$ after image recording ($\Omega$) | Change in resistance value $\Delta R/R$ | Presence or absence of breakage of heat-generating resistor | Presence or absence of strain | General evaluation ◎: excellent ○: good x: fail |
|---|---|---|---|---|---|---|---|---|
| 19 | 1.40 | 1.95 | 333 | 320 | −4% | no breakage | no strain | ○ |
| *20 | 1.50 | 1.00 | 358 | 297 | −17% | no breakage | with strain | x |
| 21 | 1.50 | 1.20 | 326 | 313 | −4% | no breakage | no strain | ○ |
| 22 | 1.50 | 1.30 | 310 | 304 | −2% | no breakage | no strain | ◎ |
| 23 | 1.50 | 1.50 | 381 | 377 | −1% | no breakage | no strain | ◎ |
| 24 | 1.50 | 1.70 | 387 | 379 | −2% | no breakage | no strain | ◎ |
| 25 | 1.50 | 1.95 | 388 | 376 | −3% | no breakage | no strain | ○ |
| *26 | 1.50 | 2.20 | 390 | 312 | −20% | no breakage | with strain | x |
| 27 | 1.60 | 1.20 | 369 | 354 | −4% | no breakage | no strain | ○ |
| 28 | 1.60 | 1.30 | 375 | 368 | −2% | no breakage | no strain | ◎ |
| 29 | 1.60 | 1.50 | 387 | 379 | −2% | no breakage | no strain | ◎ |
| 30 | 1.60 | 1.70 | 344 | 337 | −2% | no breakage | no strain | ◎ |
| 31 | 1.60 | 1.95 | 311 | 302 | −3% | no breakage | no strain | ○ |
| *32 | 1.70 | 1.10 | 326 | 284 | −13% | no breakage | with strain | x |
| 33 | 1.70 | 1.20 | 326 | 310 | −5% | no breakage | no strain | ○ |
| 34 | 1.70 | 1.30 | 350 | 340 | −3% | no breakage | no strain | ○ |
| 35 | 1.70 | 1.50 | 363 | 352 | −3% | no breakage | no strain | ○ |
| 36 | 1.70 | 1.80 | 388 | 376 | −3% | no breakage | no strain | ○ |
| 37 | 1.70 | 1.95 | 390 | 374 | −4% | no breakage | no strain | ○ |
| *38 | 1.70 | 2.00 | 368 | 324 | −12% | no breakage | with strain | x |
| *39 | 1.80 | 1.00 | 329 | 263 | −20% | no breakage | with strain | x |
| *40 | 1.80 | 1.20 | 400 | 340 | −15% | no breakage | with strain | x |
| *41 | 1.80 | 1.50 | 389 | 338 | −13% | no breakage | with strain | x |
| *42 | 1.80 | 1.95 | 333 | 303 | −9% | no breakage | with strain | x |
| *43 | 1.80 | 2.20 | 370 | 270 | −27% | no breakage | with strain | x |

Notes: Samples with a mark * are not within the scope of the present invention.

As is apparent from Table 1, with respect to ink jet heads Nos. 8 to 12, Nos. 15 to 19, Nos. 21 to 25, Nos. 27 to 31 and Nos. 33 to 37 where in the heat-generating resistor 3 is made of a material consisting of $Ta_xSiO_y$ (x and y meet the expressions: $1.30 \leqq x \leqq 1.70$ and $1.20 \leqq y \leqq 1.95$), since breakage of the heat-generating resistor 3 does not occur and, furthermore, the change in resistance value $\Delta R/R$ is within a range from 0 to −5% and is small, an image formed on a recording paper has less strain and a good image is obtained.

Particularly, with respect to ink jet heads Nos. 16 to 18, Nos. 22 to 24 and Nos. 28 to 30 wherein the heat-generating resistor 3 is made of a material consisting of $Ta_xSiO_y$ (x and y meet the expressions: $1.40 \leqq x \leqq 1.60$ and $1.30 \leqq y \leqq 1.70$), breakage of the heat-generating resistor 3 does not occur and, furthermore, since the change in resistance value $\Delta R/R$ is within a range from 0 to −2% and is very small, there is obtained an image without strain even if a predetermined power pulse is repeatedly applied at least $1.5 \times 10^8$ times. Therefore, it is found to be particularly preferably that the heat-generating resistor 3 is made of a material consisting of $Ta_xSiO_y$ (provided that x and y meet the expressions: $1.40 \leqq x \leqq 1.60$ and $1.30 \leqq y \leqq 1.70$).

With respect to ink jet heads wherein the composition of $Ta_xSiO_y$ is not within aforementioned range ($1.30 \leqq x \leqq 1.70$ and $1.20 \leqq y \leqq 1.95$), namely, ink jet heads Nos. 1 to 5 wherein x meets the expression: $x<1.30$, the heat-generating resistor 3 is broken before applying a power pulse $1.0 \times 10^8$ times to the heat-generating resistor 3, thus making it impossible to use the ink jet head. Also, with respect to ink jet heads No. 6, No. 7, No. 13, No. 14, No. 20, No. 26, No. 32 and Nos. 38 to 43 wherein the composition of $Ta_xSiO_y$ is not within aforementioned range (x and y meet the expressions: $1.30 \leqq x \leqq 1.70$ and $1.20 \leqq y \leqq 1.95$), although the heat-generating resistor 3 is not broken, the change in resistance value $\Delta R/R$ is −10% or less, or the change of resistance value is very large; therefore, strain occurs in an image and a good image is not obtained.

As is apparent from aforementioned results, in order to obtain a good image with less strain, the heat-generating resistor 3 is preferably made of a material consisting of $Ta_xSiO_y$ (provided that x and y meet the expressions: $1.30 \leqq x \leqq 1.70$ and $1.20 \leqq y \leqq 1.95$), and particularly preferably $Ta_xSiO_y$ (provided that x and y meet the expressions: $1.40 \leqq x \leqq 1.60$ and $1.30 \leqq y \leqq 1.70$).

Test Example 2

Ink Jet Head Comprising a Heat-generating Resistor Made of Aforementioned Material (2)

In an ink jet head wherein a heat-generating resistor 3 is made of a material consisting of $Nb_xSiO_y$ (provided that x and y meet the expressions: $1.4 \leqq x \leqq 1.9$ and $1.4 \leqq y \leqq 1.9$), 72 ink jet head samples (samples Nos. 1 to 72) were made by gradually changing a ratio x of Nb to Si and a ratio y of O to Si in the heat-generating resistor 3 and a change in resistance value $\Delta R/R$ of these samples was measured and, furthermore, the presence or absence of breakage of the heat-generating resistor 3 during the measurement was examined and also the presence or absence of strain of an image recorded on a recording paper was examined using the samples after the measurement. The definition of the term "change in resistance value $\Delta R/R$" and the size of a heat-generating resistor are the same as in Test Example 1. The results of aforementioned test are shown in Table 2.

TABLE 2

| Sample No. | x | y | Resistance value $\Omega_1$ before image recording ($\Omega$) | Resistance value $\Omega_2$ after image recording ($\Omega$) | Change in resistance value $\Delta R/R$ | Presence or absence of breakage of heat-generating resistor | Presence or absence of strain | General evaluation ◎: excellent ○: good x: fail |
|---|---|---|---|---|---|---|---|---|
| *1 | 1.3 | 1.2 | 201 | — | impossible to measure | breakage occurred | — | x |
| *2 | 1.3 | 1.4 | 205 | — | impossible to measure | breakage occurred | — | x |
| *3 | 1.3 | 1.5 | 219 | — | impossible to measure | breakage occurred | — | x |
| *4 | 1.3 | 1.6 | 200 | — | impossible to measure | breakage occurred | — | x |
| *5 | 1.3 | 1.7 | 201 | — | impossible to measure | breakage occurred | — | x |
| *6 | 1.3 | 1.8 | 230 | — | impossible to measure | breakage occurred | — | x |
| *7 | 1.3 | 1.9 | 232 | — | impossible to measure | breakage occurred | — | x |
| *8 | 1.3 | 2.0 | 233 | — | impossible to measure | breakage occurred | — | x |
| *9 | 1.3 | 2.2 | 240 | — | impossible to measure | breakage occurred | — | x |
| *10 | 1.4 | 1.2 | 210 | 195 | −7% | no breakage | with strain | x |
| 11 | 1.4 | 1.4 | 205 | 195 | −5% | no breakage | no strain | ○ |
| 12 | 1.4 | 1.5 | 230 | 219 | −5% | no breakage | no strain | ○ |
| 13 | 1.4 | 1.6 | 220 | 209 | −5% | no breakage | no strain | ○ |
| 14 | 1.4 | 1.7 | 213 | 202 | −5% | no breakage | no strain | ○ |
| 15 | 1.4 | 1.8 | 238 | 228 | −4% | no breakage | no strain | ○ |
| 16 | 1.4 | 1.9 | 200 | 190 | −5% | no breakage | no strain | ○ |
| *17 | 1.4 | 2.0 | 237 | 218 | −8% | no breakage | with strain | x |
| *18 | 1.4 | 2.2 | 207 | 182 | −12% | no breakage | with strain | x |
| *19 | 1.5 | 1.2 | 209 | 192 | −8% | no breakage | with strain | x |
| 20 | 1.5 | 1.4 | 212 | 204 | −4% | no breakage | no strain | ○ |
| 21 | 1.5 | 1.5 | 233 | 228 | −2% | no breakage | no strain | ◎ |
| 22 | 1.5 | 1.6 | 200 | 190 | −5% | no breakage | no strain | ○ |
| 23 | 1.5 | 1.7 | 227 | 218 | −4% | no breakage | no strain | ○ |
| 24 | 1.5 | 1.8 | 229 | 220 | −4% | no breakage | no strain | ○ |
| 25 | 1.5 | 1.9 | 208 | 198 | −5% | no breakage | no strain | ○ |
| *26 | 1.5 | 2.0 | 208 | 193 | −7% | no breakage | with strain | x |
| *27 | 1.5 | 2.2 | 230 | 200 | −13% | no breakage | with strain | x |
| *28 | 1.6 | 1.2 | 220 | 207 | −6% | no breakage | with strain | x |
| 29 | 1.6 | 1.4 | 247 | 237 | −4% | no breakage | no strain | ○ |
| 30 | 1.6 | 1.5 | 211 | 207 | −2% | no breakage | no strain | ◎ |
| 31 | 1.6 | 1.6 | 209 | 205 | −2% | no breakage | no strain | ◎ |
| 32 | 1.6 | 1.7 | 209 | 203 | −3% | no breakage | no strain | ○ |
| 33 | 1.6 | 1.8 | 208 | 200 | −4% | no breakage | no strain | ○ |
| 34 | 1.6 | 1.9 | 220 | 211 | −4% | no breakage | no strain | ○ |
| *35 | 1.6 | 2.0 | 237 | 220 | −7% | no breakage | with strain | x |
| *36 | 1.6 | 2.2 | 200 | 182 | −9% | no breakage | with strain | x |
| *37 | 1.7 | 1.2 | 209 | 196 | −6% | no breakage | with strain | x |
| 38 | 1.7 | 1.4 | 239 | 229 | −4% | no breakage | no strain | ○ |
| 39 | 1.7 | 1.5 | 209 | 205 | −2% | no breakage | no strain | ◎ |
| 40 | 1.7 | 1.6 | 211 | 209 | −1% | no breakage | no strain | ◎ |
| 41 | 1.7 | 1.7 | 224 | 220 | −2% | no breakage | no strain | ◎ |
| 42 | 1.7 | 1.8 | 238 | 226 | −5% | no breakage | no strain | ○ |
| 43 | 1.7 | 1.9 | 224 | 213 | −5% | no breakage | no strain | ○ |
| *44 | 1.7 | 2.0 | 230 | 214 | −7% | no breakage | with strain | x |
| *45 | 1.7 | 2.2 | 228 | 207 | −9% | no breakage | with strain | x |
| *46 | 1.8 | 1.2 | 210 | 195 | −7% | no breakage | with strain | x |
| 47 | 1.8 | 1.4 | 209 | 199 | −5% | no breakage | no strain | ○ |
| 48 | 1.8 | 1.5 | 220 | 216 | −2% | no breakage | no strain | ◎ |
| 49 | 1.8 | 1.6 | 209 | 207 | −1% | no breakage | no strain | ◎ |
| 50 | 1.8 | 1.7 | 218 | 216 | −1% | no breakage | no strain | ◎ |
| 51 | 1.8 | 1.8 | 207 | 203 | −2% | no breakage | no strain | ◎ |
| 52 | 1.8 | 1.9 | 219 | 210 | −4% | no breakage | no strain | ○ |
| *53 | 1.8 | 2.0 | 235 | 221 | −6% | no breakage | with strain | x |
| *54 | 1.8 | 2.2 | 210 | 183 | −13% | no breakage | with strain | x |
| *55 | 1.9 | 1.2 | 200 | 184 | −8% | no breakage | with strain | x |
| 56 | 1.9 | 1.4 | 207 | 197 | −5% | no breakage | no strain | ○ |
| 57 | 1.9 | 1.5 | 210 | 202 | −4% | no breakage | no strain | ○ |
| 58 | 1.9 | 1.6 | 229 | 220 | −4% | no breakage | no strain | ○ |
| 59 | 1.9 | 1.7 | 230 | 223 | −3% | no breakage | no strain | ○ |
| 60 | 1.9 | 1.8 | 209 | 201 | −4% | no breakage | no strain | ○ |
| 61 | 1.9 | 1.9 | 205 | 195 | −5% | no breakage | no strain | ○ |
| *62 | 1.9 | 2.0 | 206 | 190 | −8% | no breakage | with strain | x |
| *63 | 1.9 | 2.2 | 206 | 177 | −14% | no breakage | with strain | x |
| *64 | 2.0 | 1.2 | 219 | 201 | −8% | no breakage | with strain | x |

TABLE 2-continued

| Sample No. | x | y | Resistance value $\Omega_1$ before image recording ($\Omega$) | Resistance value $\Omega_2$ after image recording ($\Omega$) | Change in resistance value $\Delta R/R$ | Presence or absence of breakage of heat-generating resistor | Presence or absence of strain | General evaluation ◎: excellent ○: good x: fail |
|---|---|---|---|---|---|---|---|---|
| *65 | 2.0 | 1.4 | 207 | 193 | −7% | no breakage | with strain | x |
| *66 | 2.0 | 1.5 | 210 | 195 | −7% | no breakage | with strain | x |
| *67 | 2.0 | 1.6 | 200 | 186 | −7% | no breakage | with strain | x |
| *68 | 2.0 | 1.7 | 203 | 189 | −7% | no breakage | with strain | x |
| *69 | 2.0 | 1.8 | 217 | 204 | −6% | no breakage | with strain | x |
| *70 | 2.0 | 1.9 | 211 | 198 | −6% | no breakage | with strain | x |
| *71 | 2.0 | 2.0 | 220 | 202 | −8% | no breakage | with strain | x |
| *72 | 2.0 | 2.2 | 235 | 202 | −14% | no breakage | with strain | x |

Notes: Samples with a mark * are not within the scope of the present invention.

As is apparent from Table 2, with respect to ink jet heads Nos. 11 to 16, Nos. 20 to 25, Nos. 29 to 34, Nos. 38 to 43, Nos. 47 to 52 and Nos. 56 to 61 wherein the heat-generating resistor 3 is made of a material consisting of $Nb_xSiO_y$ (provided that x and y meet the expressions: $1.4 \leqq x \leqq 1.9$ and $1.4 \leqq y \leqq 1.9$), since breakage of the heat-generating resistor 3 does not occur and, furthermore, the change in resistance value $\Delta R/R$ is within a range from 0 to −5% and the change in resistance value of the heat-generating resistor 3 is small. Therefore, an image formed on a recording paper has no strain and a good image is obtained.

Particularly, with respect to ink jet heads No. 21, No. 30, No. 31, Nos. 39 to 41 and Nos. 48 to 51 wherein the heat-generating resistor 3 is made of a material consisting of $Nb_xSiO_y$ (provided that x and y meet the expressions: $1.5 \leqq x \leqq 1.8$, $1.5 \leqq y \leqq 1.8$ and $y \leqq x$), breakage of the heat-generating resistor 3 does not occur and, furthermore, since the change in resistance value $\Delta R/R$ is within a range from 0 to −2% and the change in resistance value of the heat-generating resistor 3 is very small, there is obtained an image without strain even if a predetermined power pulse is repeatedly applied at least $1.5 \times 10^8$ times. Therefore, it is found to be particularly preferably that the heat-generating resistor 3 is made of a material consisting of $Nb_xSiO_y$ (x and y meet the expression: $1.5 \leqq x \leqq 1.8$, $1.5 \leqq y \leqq 1.8$ and $y \leqq x$).

With respect to ink jet heads Nos. 1 to 9 wherein x meets the expression: $x \leqq 1.4$, the heat-generating resistor 3 is broken before applying a power pulse $1.0 \times 10^8$ times to the heat-generating resistor 3, thus making it impossible to use the ink jet head.

Also, with respect to ink jet heads of the heat-generating resistor 3 No. 10, Nos. 17 to 19, Nos. 26 to 28, Nos. 35 to 37, Nos. 44 to 46, Nos. 53 to 55 and Nos. 62 to 72 wherein x and y of $Nb_xSiO_3$ ($1.4 \leqq x \leqq 1.9$ and $1.4 \leqq y \leqq 1.9$), although the heat-generating resistor 3 is not broken, the change in resistance value $\Delta R/R$ is −10% or less, or the change of resistance value is very large. Therefore, strain occurs in an image and a good image is not obtained.

As is apparent from aforementioned results, in order to obtain a good image with less strain, the heat-generating resistor 3 is preferably made of a material consisting of $Nb_xSiO_y$ ($1.4 \leqq x \leqq 1.9$ and $1.4 \leqq y \leqq 1.9$), breakage of the heat-generating resistor 3 does not occur and, furthermore, there is obtained an image without strain by making the heat-generating resistor 3 of a material consisting of $Nb_xSiO_y$ (provided that x and y meet the expressions: $1.5 \leqq x \leqq 1.8$, $1.5 \leqq y \leqq 1.8$ and $y \leqq x$) even if a power pulse is repeatedly applied at least $1.5 \times 10^8$ times.

Test Example 3

Ink Jet Head Comprising a Heat-generating Resistor Made of Aforementioned Material (3)

In an ink jet head wherein a heat-generating resistor 3 is made of a TiC—$SiO_2$resistive material, a TiC content in the resistive material being set within a range from 55 to 90 atomic %, 8 ink jet head samples (samples Nos. 1 to 8) were made by gradually changing the TiC content and a change in resistance value $\Delta R/R$ of these samples was individually measured and, furthermore, the presence or absence of breakage of the heat-generating resistor during the measurement was examined and also the presence or absence of strain of an image recorded on a recording paper was examined using the samples after the measurement.

The definition of the term "change in resistance value $\Delta R/R$" and the size of the heat-generating resistor are the same as in Test Example 1. The results of aforementioned test are shown in Table 3.

TABLE 3

| Sample No. | TiC | $SiO_2$ | Initial resistance value $\Omega_1$ ($\Omega$) | Resistance value $\Omega_2$ after pulse application test ($\Omega$) | Change in resistance value $\Delta R/R$ | Presence or absence of breakage of heat-generating resistor | Presence or absence of image strain | General evaluation ◎: excellent ○: good x: fail |
|---|---|---|---|---|---|---|---|---|
| *1 | 50 | 50 | 550 | — | impossible to measure | breakage occurred | — | x |
| 2 | 55 | 45 | 200 | 192 | −4% | no breakage | no strain | ○ |
| 3 | 60 | 40 | 190 | 184 | −3% | no breakage | no strain | ◎ |
| 4 | 70 | 30 | 190 | 186 | −2% | no breakage | no strain | ◎ |
| 5 | 80 | 20 | 220 | 213 | −3% | no breakage | no strain | ◎ |
| 6 | 90 | 10 | 210 | 200 | −5% | no breakage | no strain | ○ |

TABLE 3-continued

| Sample No. | TiC | $SiO_2$ | Initial resistance value $\Omega_1$ ($\Omega$) | Resistance value $\Omega_2$ after pulse application test ($\Omega$) | Change in resistance value $\Delta R/R$ | Presence or absence of breakage of heat-generating resistor | Presence or absence of image strain | General evaluation ⊙: excellent ○: good x: fail |
|---|---|---|---|---|---|---|---|---|
| *7 | 95 | 5 | 205 | 187 | −9% | no breakage | with strain | x |
| *8 | 100 | 0 | 240 | 168 | −30% | no breakage | with strain | x |

Notes: Samples with a mark * are not within the scope of the present invention.

As is apparent from the test results shown in Table 3, with respect to ink jet heads Nos. 2 to 6 wherein the TiC content in the heat-generating resistor is set within a range from 55 to 90 atomic %, there is not any sample wherein the heat-generating resistor is broken and the change in resistance value $\Delta R/R$ is within a narrow range from −2 to −5% and, therefore, a good image with no strain is obtained in a printing test.

Particularly, with respect to ink jet heads No. 3, No. 4 and No. 5 wherein the TiC content is set within a range from 60 to 80 atomic %, the change in resistance value $\Delta R/R$ is within a very narrow range of −3% or less, or the change in resistance value of the heat-generating resistor is markedly reduced.

To the contrary, with respect to the ink jet head sample No. 1 wherein the TiC content is smaller than 55 mol %, the heat-generating resistor is broken before applying a power pulse $1.0\times10^8$ times to the heat-generating resistor, thus making it impossible to use the ink jet head.

With respect to ink jet head samples Nos. 7 and 8 wherein the TiC content is larger than 90 mol %, although the heat-generating resistor is not broken, the change in resistance value $\Delta R/R$ is −9% or less, or the change of resistance value is very large and, therefore, strain of an image was confirmed in a printing test.

As is apparent from aforementioned test results, in order to effectively prevent breakage of the heat-generating resistor and to reduce a change in resistance value of the heat-generating resistor, thereby to obtain a good image with no strain, the change in resistance value of the heat-generating resistor can be effectively reduced when the TiC content in the heat-generating resistor is preferably set within a range from 55 to 90 atomic %, and particularly preferably from 60 to 80 mol %.

Test Example 4

Ink Jet Head Comprising a Heat-generating Resistor Made of Aforementioned Material (4)

In an ink jet head wherein a heat-generating resistor 3 is made of a Ta—Ni—$SiO_x$ (provided that x meets the expression: $1.2\leqq x\leqq 2.0$) material, a tantalum (Ta) content in the resistive material being set within a range from 48 to 70 atomic %, a nickel (Ni) content being set within a range from 0.1 to 2.0 atomic %, 180 ink jet head samples (samples Nos. 1 to 180) were made by gradually changing a ratio X of oxygens (O) to silicons (Si) in the heat-generating resistor as well as the tantalum (Ta) content and the nickel (Ni) content and a change in resistance value $\Delta R/R$ of these samples was individually measured and, furthermore, the presence or absence of breakage of the heat-generating resistor during the measurement was examined and also the presence or absence of strain of an image recorded on a recording paper was examined using the samples after the measurement.

The definition of the term "change in resistance value $\Delta R/R$" and the size of the heat-generating resistor are the same as in Test Example 1. The results of aforementioned test are shown in Table 4 to Table 8.

TABLE 4

| Sample No. | Ratio x of O to Si | Ta content | Ni content | Resistance value $\Omega_1$ before image recording ($\Omega$) | Resistance value $\Omega_2$ after image recording ($\Omega$) | Change in resistance value $\Delta R/R$ | Presence or absence of breakage of heat-generating resistor | Presence or absence of strain | General evaluation ⊙: excellent ○: good x: fail |
|---|---|---|---|---|---|---|---|---|---|
| *1 | 1.1 | 75 | 0.0 | 23 | — | impossible to measure | breakage occurred | — | x |
| *2 | 1.1 | 75 | 0.1 | 23 | — | impossible to measure | breakage occurred | — | x |
| *3 | 1.1 | 75 | 0.5 | 22 | — | impossible to measure | breakage occurred | — | x |
| *4 | 1.1 | 75 | 1.0 | 21 | — | impossible to measure | breakage occurred | — | x |
| *5 | 1.1 | 75 | 2.0 | 25 | — | impossible to measure | breakage occurred | — | x |
| *6 | 1.1 | 75 | 3.0 | 25 | — | impossible to measure | breakage occurred | — | x |
| *7 | 1.1 | 70 | 0.0 | 30 | 27 | −10% | no breakage | with strain | x |
| *8 | 1.1 | 70 | 0.1 | 32 | 30 | −5% | no breakage | no strain | x |
| *9 | 1.1 | 70 | 0.5 | 30 | 29 | −2% | no breakage | no strain | x |
| *10 | 1.1 | 70 | 1.0 | 30 | 29 | −2% | no breakage | no strain | x |
| *11 | 1.1 | 70 | 2.0 | 30 | 29 | −5% | no breakage | no strain | x |

TABLE 4-continued

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ⊙: excellent ○: good x: fail |
|---|---|---|---|---|---|---|---|---|---|
| *12 | 1.1 | 70 | 3.0 | 31 | 28 | −11% | no breakage | with strain | x |
| *13 | 1.1 | 60 | 0.0 | 44 | 40 | −9% | no breakage | with strain | x |
| *14 | 1.1 | 60 | 0.1 | 40 | 39 | −3% | no breakage | no strain | x |
| *15 | 1.1 | 60 | 0.5 | 40 | 39 | −2% | no breakage | no strain | x |
| *16 | 1.1 | 60 | 1.0 | 40 | 40 | −1% | no breakage | no strain | x |
| *17 | 1.1 | 60 | 2.0 | 40 | 39 | −3% | no breakage | no strain | x |
| *18 | 1.1 | 60 | 3.0 | 40 | 36 | −10% | no breakage | with strain | x |
| *19 | 1.1 | 50 | 0.0 | 41 | 37 | −9% | no breakage | with strain | x |
| *20 | 1.1 | 50 | 0.1 | 40 | 38 | −4% | no breakage | no strain | x |
| *21 | 1.1 | 50 | 0.5 | 40 | 39 | −2% | no breakage | no strain | x |
| *22 | 1.1 | 50 | 1.0 | 42 | 41 | −2% | no breakage | no strain | x |
| *23 | 1.1 | 50 | 2.0 | 40 | 38 | −5% | no breakage | no strain | x |
| *24 | 1.1 | 50 | 3.0 | 39 | 35 | −10% | no breakage | with strain | x |
| *25 | 1.1 | 48 | 0.0 | 40 | 36 | −9% | no breakage | with strain | x |
| *26 | 1.1 | 48 | 0.1 | 40 | 38 | −4% | no breakage | no strain | x |
| *27 | 1.1 | 48 | 0.5 | 40 | 40 | −1% | no breakage | no strain | x |
| *28 | 1.1 | 48 | 1.0 | 40 | 40 | −1% | no breakage | no strain | x |
| *29 | 1.1 | 48 | 2.0 | 42 | 40 | −5% | no breakage | no strain | x |
| *30 | 1.1 | 48 | 3.0 | 44 | 39 | −12% | no breakage | with strain | x |
| *31 | 1.1 | 46 | 0.0 | 50 | — | impossible to measure | breakage occurred | — | x |
| *32 | 1.1 | 46 | 0.1 | 50 | — | impossible to measure | breakage occurred | — | x |
| *33 | 1.1 | 46 | 0.5 | 52 | — | impossible to measure | breakage occurred | — | x |
| *34 | 1.1 | 46 | 1.0 | 51 | — | impossible to measure | breakage occurred | — | x |
| *35 | 1.1 | 46 | 2.0 | 50 | — | impossible to measure | breakage occurred | — | x |
| *36 | 1.1 | 46 | 3.0 | 52 | — | impossible to measure | breakage occurred | — | x |

Notes: Samples with a mark * are not within the scope of the present invention.

TABLE 5

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ⊙: excellent ○: good x: fail |
|---|---|---|---|---|---|---|---|---|---|
| *37 | 1.2 | 75 | 0.0 | 311 | — | impossible to measure | breakage occurred | — | x |
| *38 | 1.2 | 75 | 0.1 | 329 | — | impossible to measure | breakage occurred | — | x |
| *39 | 1.2 | 75 | 0.5 | 310 | — | impossible to measure | breakage occurred | — | x |
| *40 | 1.2 | 75 | 1.0 | 340 | — | impossible to measure | breakage occurred | — | x |
| *41 | 1.2 | 75 | 2.0 | 315 | — | impossible to measure | breakage occurred | — | x |
| *42 | 1.2 | 75 | 3.0 | 332 | — | impossible to measure | breakage occurred | — | x |
| *43 | 1.2 | 70 | 0.0 | 329 | 299 | −9% | no breakage | with strain | x |
| 44 | 1.2 | 70 | 0.1 | 310 | 298 | −4% | no breakage | no strain | ○ |
| 45 | 1.2 | 70 | 0.5 | 308 | 302 | −2% | no breakage | no strain | ⊙ |
| 46 | 1.2 | 70 | 1.0 | 311 | 308 | −1% | no breakage | no strain | ⊙ |
| 47 | 1.2 | 70 | 2.0 | 340 | 323 | −5% | no breakage | no strain | ○ |
| *48 | 1.2 | 70 | 3.0 | 342 | 304 | −11% | no breakage | with strain | x |
| *49 | 1.2 | 60 | 0.0 | 341 | 310 | −9% | no breakage | with strain | x |
| 50 | 1.2 | 60 | 0.1 | 320 | 304 | −5% | no breakage | no strain | ○ |
| 51 | 1.2 | 60 | 0.5 | 323 | 320 | −1% | no breakage | no strain | ⊙ |
| 52 | 1.2 | 60 | 1.0 | 304 | 301 | −1% | no breakage | no strain | ⊙ |
| 53 | 1.2 | 60 | 2.0 | 319 | 309 | −3% | no breakage | no strain | ○ |
| *54 | 1.2 | 60 | 3.0 | 321 | 289 | −10% | no breakage | with strain | x |
| *55 | 1.2 | 50 | 0.0 | 340 | 316 | −7% | no breakage | with strain | x |
| 56 | 1.2 | 50 | 0.1 | 350 | 333 | −5% | no breakage | no strain | ○ |

TABLE 5-continued

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ◎: excellent ○: good x: fail |
|---|---|---|---|---|---|---|---|---|---|
| 57 | 1.2 | 50 | 0.5 | 301 | 295 | −2% | no breakage | no strain | ◎ |
| 58 | 1.2 | 50 | 1.0 | 321 | 318 | −1% | no breakage | no strain | ◎ |
| 59 | 1.2 | 50 | 2.0 | 305 | 290 | −5% | no breakage | no strain | ○ |
| *60 | 1.2 | 50 | 3.0 | 350 | 315 | −10% | no breakage | with strain | x |
| *61 | 1.2 | 48 | 0.0 | 320 | 294 | −8% | no breakage | with strain | x |
| 62 | 1.2 | 48 | 0.1 | 322 | 309 | −4% | no breakage | no strain | ○ |
| 63 | 1.2 | 48 | 0.5 | 289 | 286 | −1% | no breakage | no strain | ◎ |
| 64 | 1.2 | 48 | 1.0 | 338 | 335 | −1% | no breakage | no strain | ◎ |
| 65 | 1.2 | 48 | 2.0 | 302 | 287 | −5% | no breakage | no strain | ○ |
| *66 | 1.2 | 48 | 3.0 | 350 | 308 | −12% | no breakage | with strain | x |
| *67 | 1.2 | 46 | 0.0 | 320 | — | impossible to measure | breakage occurred | — | x |
| *68 | 1.2 | 46 | 0.1 | 344 | — | impossible to measure | breakage occurred | — | x |
| *69 | 1.2 | 46 | 0.5 | 320 | — | impossible to measure | breakage occurred | — | x |
| *70 | 1.2 | 46 | 1.0 | 312 | — | impossible to measure | breakage occurred | — | x |
| *71 | 1.2 | 46 | 2.0 | 319 | — | impossible to measure | breakage occurred | — | x |
| *72 | 1.2 | 46 | 3.0 | 310 | — | impossible to measure | breakage occurred | — | x |

Notes: Samples with a mark * are not within the scope of the present invention.

TABLE 6

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ◎: excellent ○: good x: fail |
|---|---|---|---|---|---|---|---|---|---|
| *73 | 1.5 | 75 | 0.0 | 340 | — | impossible to measure | breakage occurred | — | x |
| *74 | 1.5 | 75 | 0.1 | 335 | — | impossible to measure | breakage occurred | — | x |
| *75 | 1.5 | 75 | 0.5 | 308 | — | impossible to measure | breakage occurred | — | x |
| *76 | 1.5 | 75 | 1.0 | 320 | — | impossible to measure | breakage occurred | — | x |
| *77 | 1.5 | 75 | 2.0 | 311 | — | impossible to measure | breakage occurred | — | x |
| *78 | 1.5 | 75 | 3.0 | 330 | — | impossible to measure | breakage occurred | — | x |
| *79 | 1.5 | 70 | 0.0 | 306 | 285 | −7% | no breakage | with strain | x |
| 80 | 1.5 | 70 | 0.1 | 325 | 312 | −4% | no breakage | no strain | ○ |
| 81 | 1.5 | 70 | 0.5 | 304 | 301 | −1% | no breakage | no strain | ◎ |
| 82 | 1.5 | 70 | 1.0 | 300 | 294 | −2% | no breakage | no strain | ◎ |
| 83 | 1.5 | 70 | 2.0 | 326 | 313 | −4% | no breakage | no strain | ○ |
| *84 | 1.5 | 70 | 3.0 | 325 | 283 | −13% | no breakage | with strain | x |
| *85 | 1.5 | 60 | 0.0 | 321 | 289 | −10% | no breakage | with strain | x |
| 86 | 1.5 | 60 | 0.1 | 316 | 300 | −5% | no breakage | no strain | ○ |
| 87 | 1.5 | 60 | 0.5 | 319 | 313 | −2% | no breakage | no strain | ◎ |
| 88 | 1.5 | 60 | 1.0 | 306 | 300 | −2% | no breakage | no strain | ◎ |
| 89 | 1.5 | 60 | 2.0 | 342 | 332 | −3% | no breakage | no strain | ○ |
| *90 | 1.5 | 60 | 3.0 | 320 | 282 | −12% | no breakage | with strain | x |
| *91 | 1.5 | 50 | 0.0 | 336 | 306 | −9% | no breakage | with strain | x |
| 92 | 1.5 | 50 | 0.1 | 335 | 318 | −5% | no breakage | no strain | ○ |
| 93 | 1.5 | 50 | 0.5 | 298 | 295 | −1% | no breakage | no strain | ◎ |
| 94 | 1.5 | 50 | 1.0 | 306 | 303 | −1% | no breakage | no strain | ◎ |
| 95 | 1.5 | 50 | 2.0 | 312 | 296 | −5% | no breakage | no strain | ○ |
| *96 | 1.5 | 50 | 3.0 | 335 | 298 | −11% | no breakage | with strain | x |
| *97 | 1.5 | 48 | 0.0 | 331 | 305 | −8% | no breakage | with strain | x |
| 98 | 1.5 | 48 | 0.1 | 315 | 302 | −4% | no breakage | no strain | ○ |
| 99 | 1.5 | 48 | 0.5 | 286 | 283 | −1% | no breakage | no strain | ◎ |
| 100 | 1.5 | 48 | 1.0 | 325 | 319 | −2% | no breakage | no strain | ◎ |
| 101 | 1.5 | 48 | 2.0 | 300 | 288 | −4% | no breakage | no strain | ○ |

TABLE 6-continued

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ⊚: excellent ○: good x: fail |
|---|---|---|---|---|---|---|---|---|---|
| *102 | 1.5 | 48 | 3.0 | 345 | 300 | −13% | no breakage | with strain | x |
| *103 | 1.5 | 46 | 0.0 | 456 | — | impossible to measure | breakage occurred | — | x |
| *104 | 1.5 | 46 | 0.1 | 460 | — | impossible to measure | breakage occurred | — | x |
| *105 | 1.5 | 46 | 0.5 | 445 | — | impossible to measure | breakage occurred | — | x |
| *106 | 1.5 | 46 | 1.0 | 502 | — | impossible to measure | breakage occurred | — | x |
| *107 | 1.5 | 46 | 2.0 | 550 | — | impossible to measure | breakage occurred | — | x |
| *108 | 1.5 | 46 | 3.0 | 598 | — | impossible to measure | breakage occurred | — | x |

Notes: Samples with a mark * are not within the scope of the present invention.

TABLE 7

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ⊚: excellent ○: good x: fail |
|---|---|---|---|---|---|---|---|---|---|
| *109 | 2.0 | 75 | 0.0 | 301 | — | impossible to measure | breakage occurred | — | x |
| *110 | 2.0 | 75 | 0.1 | 319 | — | impossible to measure | breakage occurred | — | x |
| *111 | 2.0 | 75 | 0.5 | 301 | — | impossible to measure | breakage occurred | — | x |
| *112 | 2.0 | 75 | 1.0 | 330 | — | impossible to measure | breakage occurred | — | x |
| *113 | 2.0 | 75 | 2.0 | 305 | — | impossible to measure | breakage occurred | — | x |
| *114 | 2.0 | 75 | 3.0 | 320 | — | impossible to measure | breakage occurred | — | x |
| *115 | 2.0 | 70 | 0.0 | 319 | 293 | −8% | no breakage | with strain | x |
| 116 | 2.0 | 70 | 0.1 | 300 | 285 | −5% | no breakage | no strain | ○ |
| 117 | 2.0 | 70 | 0.5 | 298 | 292 | −2% | no breakage | no strain | ⊚ |
| 118 | 2.0 | 70 | 1.0 | 301 | 295 | −2% | no breakage | no strain | ⊚ |
| 119 | 2.0 | 70 | 2.0 | 330 | 314 | −5% | no breakage | no strain | ○ |
| *120 | 2.0 | 70 | 3.0 | 333 | 300 | −10% | no breakage | with strain | x |
| *121 | 2.0 | 60 | 0.0 | 330 | 304 | −8% | no breakage | with strain | x |
| 122 | 2.0 | 60 | 0.1 | 310 | 298 | −4% | no breakage | no strain | ○ |
| 123 | 2.0 | 60 | 0.5 | 323 | 320 | −1% | no breakage | no strain | ⊚ |
| 124 | 2.0 | 60 | 1.0 | 304 | 301 | −1% | no breakage | no strain | ⊚ |
| 125 | 2.0 | 60 | 2.0 | 309 | 300 | −3% | no breakage | no strain | ○ |
| *126 | 2.0 | 60 | 3.0 | 321 | 289 | −10% | no breakage | with strain | x |
| *127 | 2.0 | 50 | 0.0 | 340 | 313 | −8% | no breakage | with strain | x |
| 128 | 2.0 | 50 | 0.1 | 340 | 323 | −5% | no breakage | no strain | ○ |
| 129 | 2.0 | 50 | 0.5 | 290 | 284 | −2% | no breakage | no strain | ⊚ |
| 130 | 2.0 | 50 | 1.0 | 321 | 315 | −2% | no breakage | no strain | ⊚ |
| 131 | 2.0 | 50 | 2.0 | 305 | 290 | −5% | no breakage | no strain | ○ |
| *132 | 2.0 | 50 | 3.0 | 330 | 297 | −10% | no breakage | with strain | x |
| *133 | 2.0 | 48 | 0.0 | 320 | 294 | −8% | no breakage | with strain | x |
| 134 | 2.0 | 48 | 0.1 | 313 | 297 | −5% | no breakage | no strain | ○ |
| 135 | 2.0 | 48 | 0.5 | 289 | 283 | −2% | no breakage | no strain | ⊚ |
| 136 | 2.0 | 48 | 1.0 | 338 | 331 | −2% | no breakage | no strain | ⊚ |
| 137 | 2.0 | 48 | 2.0 | 302 | 287 | −5% | no breakage | no strain | ○ |
| *138 | 2.0 | 48 | 3.0 | 337 | 303 | −10% | no breakage | with strain | x |
| *139 | 2.0 | 46 | 0.0 | 524 | — | — | — | — | x |
| *140 | 2.0 | 46 | 0.1 | 617 | — | — | — | — | x |
| *141 | 2.0 | 46 | 0.5 | 488 | — | — | — | — | x |
| *142 | 2.0 | 46 | 1.0 | 870 | — | — | — | — | x |
| *143 | 2.0 | 46 | 2.0 | 696 | — | — | — | — | x |
| *144 | 2.0 | 46 | 3.0 | 972 | — | — | — | — | x |

Notes: Samples with a mark * are not within the scope of the present invention.

TABLE 8

| Sample No. | Ratio x of O to Si | Ta content | Ni content | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ◎: excellent ○: good x: fail |
|---|---|---|---|---|---|---|---|---|---|
| *145 | 2.1 | 75 | 0.0 | 838 | — | — | — | — | x |
| *146 | 2.1 | 75 | 0.1 | 802 | — | — | — | — | x |
| *147 | 2.1 | 75 | 0.5 | 800 | — | — | — | — | x |
| *148 | 2.1 | 75 | 1.0 | 804 | — | — | — | — | x |
| *149 | 2.1 | 75 | 2.0 | 860 | — | — | — | — | x |
| *150 | 2.1 | 75 | 3.0 | 860 | — | — | — | — | x |
| *151 | 2.1 | 70 | 0.0 | 1023 | — | — | — | — | x |
| *152 | 2.1 | 70 | 0.1 | 1002 | — | — | — | — | x |
| *153 | 2.1 | 70 | 0.5 | 1002 | — | — | — | — | x |
| *154 | 2.1 | 70 | 1.0 | 1030 | — | — | — | — | x |
| *155 | 2.1 | 70 | 2.0 | 1025 | — | — | — | — | x |
| *156 | 2.1 | 70 | 3.0 | 1012 | — | — | — | — | x |
| *157 | 2.1 | 60 | 0.0 | 1130 | — | — | — | — | x |
| *158 | 2.1 | 60 | 0.1 | 1340 | — | — | — | — | x |
| *159 | 2.1 | 60 | 0.5 | 1201 | — | — | — | — | x |
| *160 | 2.1 | 60 | 1.0 | 1150 | — | — | — | — | x |
| *161 | 2.1 | 60 | 2.0 | 1220 | — | — | — | — | x |
| *162 | 2.1 | 60 | 3.0 | 1240 | — | — | — | — | x |
| *163 | 2.1 | 50 | 0.0 | 1720 | — | — | — | — | x |
| *164 | 2.1 | 50 | 0.1 | 1850 | — | — | — | — | x |
| *165 | 2.1 | 50 | 0.5 | 1900 | — | — | — | — | x |
| *166 | 2.1 | 50 | 1.0 | 1840 | — | — | — | — | x |
| *167 | 2.1 | 50 | 2.0 | 1800 | — | — | — | — | x |
| *168 | 2.1 | 50 | 3.0 | 1830 | — | — | — | — | x |
| *169 | 2.1 | 48 | 0.0 | 2030 | — | — | — | — | x |
| *170 | 2.1 | 48 | 0.1 | 2610 | — | — | — | — | x |
| *171 | 2.1 | 48 | 0.5 | 2430 | — | — | — | — | x |
| *172 | 2.1 | 48 | 1.0 | 2630 | — | — | — | — | x |
| *173 | 2.1 | 48 | 2.0 | 2410 | — | — | — | — | x |
| *174 | 2.1 | 48 | 3.0 | 2020 | — | — | — | — | x |
| *175 | 2.1 | 46 | 0.0 | 7840 | — | — | — | — | x |
| *176 | 2.1 | 46 | 0.1 | 5980 | — | — | — | — | x |
| *177 | 2.1 | 46 | 0.5 | 7200 | — | — | — | — | x |
| *178 | 2.1 | 46 | 1.0 | 6400 | — | — | — | — | x |
| *179 | 2.1 | 46 | 2.0 | 4600 | — | — | — | — | x |
| *180 | 2.1 | 46 | 3.0 | 5010 | — | — | — | — | x |

Notes: Samples with a mark * are not within the scope of the present invention.

As is apparent from the test results shown in Tables 4 to 8, with respect to ink jet heads Nos. 44 to 47, Nos. 50 to 53, Nos. 56 to 59, Nos. 62 to 65, Nos. 80 to 83, Nos. 86 to 89, Nos. 92 to 95, Nos. 98 to 101, Nos. 116 to 119, No. 122 to 125, Nos. 128 to 131 and Nos. 134 to 137 wherein the ratio x of oxygens (O) to silicons (Si) in the heat-generating resistor 3 made of the Ta—Ni—$SiO_x$ material is allowed to meet the following expression: $1.2 \leqq x \leqq 2.0$, the tantalum (Ta) content in the heat-generating resistor is set within a range from 48 to 70 atomic %, and the nickel (Ni) content is set within a range from 0.1 to 2.0 atomic %, there is not any sample wherein the heat-generating resistor is broken and the change in resistance value ΔR/R is within a narrow range from 0 to −5% and, therefore, a good image with no strain is obtained in a printing test.

Particularly, with respect to ink jet heads No. 45, No. 46, No. 51, No. 52, No. 57, No. 58, No. 63, No. 64, No. 81, No. 82, No. 87, No. 88, No. 93, No. 94, No. 99, No. 100, No. 117, No. 118, No. 123, No. 124, No. 129, No. 130, No. 135 and No. 136 wherein the nickel (Ni) content is set with in a range from 0.5 to 1.0 atomic %, the change in resistance value ΔR/R is within a narrow range from 0 to −2%, or the change of resistance value is markedly reduced to a small value.

To the contrary, with respect to ink jet head samples No. 43, No. 49, No. 55, No. 61, No. 79, No. 85, No. 91, No. 97, No. 115, No. 121, No. 127 and No. 133 wherein the nickel (Ni) content is set to 0.1 atomic % or less and ink jet head samples No. 48, No. 54, No. 60, No. 66, No. 84, No. 90, No. 96, No. 102, No. 120, No. 126, No. 132 and No. 138 wherein the nickel (Ni) content is set to a value larger than 2.0 atomic % even if the ratio x of oxygens (O) to silicons (Si) in the heat-generating resistor made of the Ta—Ni—$SiO_x$ material is allowed to meet the following expression: $1.2 \leqq x \leqq 2.0$ and the tantalum (Ta) content is set within a range from 48 to 70 atomic %, the change in resistance value ΔR/R is −8% or less, or the change of resistance value is very large; therefore, strain of an image is confirmed in a printing test.

On the other hand, with respect to ink jet head samples Nos. 1 to 6, Nos. 31 to 42, Nos. 67 to 78 and Nos. 103 to 114 wherein the tantalum (Ta) content is larger than 70 atomic % or the tantalum (Ta) content is smaller than 48 atomic %, the heat-generating resistor is broken before applying a power pulse $1.0 \times 10^8$ times to the heat-generating resistor, thus making it impossible to use the ink jet head. With respect to ink jet head samples Nos. 139 to 144, since the resistance value is very large such as 480Ω or more, an ink jet head sample, which can be used in case of high-speed recording with a driving cycle of 0.1 msec or less, could not be obtained.

With respect to ink jet head samples Nos. 7 to 30 wherein the ratio x of oxygens (O) to silicons (Si) meets the following expression: $x<1.2$, since the resistance value of the heat-generating resistor is too small before and after image recording, the power consumption of the ink jet head became too large. With respect to ink jet head samples Nos. 145 to 180 wherein the ratio x of oxygens (O) to silicons (Si) meets the following expression: $x>2.0$, since the resistance value of the heat-generating resistor becomes too large such as 800Ω or more, an ink jet head sample, which can be used in case of high-speed recording with a driving cycle of 0.1 msec or less, could not be obtained.

As is apparent from aforementioned test results, in order to effectively prevent breakage of the heat-generating resistor and to reduce a change of resistance value, thereby to obtain a good image without strain, the ratio x of oxygens to silicons in the heat-generating resistor is preferably allowed to meet the following expression: $1.2 \leqq x \leqq 2.0$, the tantalum (Ta) content in the heat-generating resistor is preferably set within a range from 48 to 70 atomic %, and the nickel (Ni) content is preferably set within a range from 0.1 to 2.0 atomic %, and also the change in resistance value of the heat-generating resistor can be effectively reduced when the nickel (Ni) content is preferably set within a range from 0.5 to 1.0 atomic %.

Reference Test Example 1

In ink jet head wherein a heat-generating resistor 3 is made of $Ta_xSi_yO_z$ (provided that x, y and z meet the expressions: $30 \leqq x \leqq 40$, $10 \leqq y \leqq 20$ and $40 \leqq z \leqq 60$), five ink jet head samples Nos.1 to 5 were made by changing a ratio x of Ta, a ratio y of Si and a ratio z of O as shown in Table 9. With regard to these samples, a change in resistance value ΔR/R was individually measured by the same method as in Test Example 1 and, furthermore, the presence or absence of breakage of the heat-generating resistor during the measurement was examined and also the presence or absence of strain of an image recorded on a recording paper was examined using the samples after the measurement. The results of aforementioned test are shown in Table 9.

less, or the change of resistant value is very large and, therefore, a good image with no strain is obtained in a printing test.

These results show that, although $Ta_xSi_yO_z$ (provided that x, y and z meet the expressions: $30 \leqq x \leqq 40$, $10 \leqq y \leqq 20$ and $40 \leqq z \leqq 60$) can be used suitably as the heat-generating resistor in a thermal head as disclosed in Japanese published examined patent application (Tokkyo koho) No.12689/1995, but the above $Ta_xSi_yO_z$ can not be used as an ink jet head. It is understood in consideration of the results of Test Example 1 that whether a $Ta_xSi_yO_z$ material is applicable as an ink jet head or a thermal head, it depends on an element composition of $Ta_xSi_yO_z$.

What is claimed is:

1. An ink jet head comprising a head substrate, a heat-generating resistor and a pair of electrodes, which are attached on the head substrate, and a top plate disposed above the head substrate, the ink jet head being capable of ejecting ink, with which the space between the head substrate and the top plate is filled, through an ink ejection opening by means of heat of the heat-generating resistor, wherein the heat-generating resistor is made of a silicon oxide material selected from the group consisting of (1) a material consisting of $Ta_xSiO_y$ (provided that x and y meet the expressions: $1.30 \leqq x \leqq 1.70$ and $1.20 \leqq y \leqq 1.95$), (2) a material consisting of $Nb_xSiO_y$ (provided that x and y meet the expressions: $1.4 \leqq x \leqq 1.9$ and $1.4 \leqq y \leqq 1.9$), (3) a TiC—$SiO_2$ resistive material, a TiC content in the resistive material being set within a range from 55 to 90 mol %, and (4) a Ta—Ni—$SiO_x$ (provided that x meets the expression: $1.2 \leqq x \leqq 2.0$) resistive material, a tantalum (Ta) content in the resistive material being set within a range from 48 to 70 atomic %, a nickel (Ni) content being set within a range from 0.1 to 2.0 atomic %.

2. The ink jet head according to claim 1, wherein the heat-generating resistor is coated with a protective layer made of an inorganic compound containing at least 0.5 atomic % of oxygens (O).

3. The ink jet head according to claim 2, wherein the protective layer is made of a Si—O—N inorganic compound.

4. The ink jet head according to claim 2, wherein the oxygen content in the protective layer is gradually increased toward the side of heat-generating resistor.

TABLE 9

| Sample No. | X | y | z | Resistance value $\Omega_1$ before image recording (Ω) | Resistance value $\Omega_2$ after image recording (Ω) | Change in resistance value ΔR/R | Presence or absence of breakage of heat-generating resistor | Presence or absence of strain | General evaluation ⊙: excellent ○: good x: fail |
|---|---|---|---|---|---|---|---|---|---|
| 1 | 30 | 20 | 50 | 305 | 235 | −23% | no breakage | With strain | x |
| 2 | 30 | 10 | 60 | 310 | 220 | −29% | no breakage | with strain | x |
| 3 | 35 | 15 | 50 | 322 | 238 | −26% | no breakage | with strain | x |
| 4 | 40 | 20 | 40 | 345 | 304 | −12% | no breakage | with strain | x |
| 5 | 40 | 10 | 50 | 300 | 207 | −31% | no breakage | with strain | x |

As is apparent from the test results shown in Table 9, with respect to ink jet heads wherein the heat-generating resistor is made of $Ta_xSi_yO_z$ (provided that x, y and z meet the expressions: $30 \leqq x \leqq 40$, $10 \leqq y \leqq 20$ and $40 \leqq z \leqq 60$), there is not any sample wherein the heat-generating resistor is broken, but the change in resistance value ΔR/R is −10% or

5. The ink jet head according to claim 1, wherein a pair of the electrodes are made of aluminum (Al) and contain 0.01 to 0.1 atomic % of silicon (Si) in the vicinity of an interface with the heat-generating resistor.

* * * * *